US005857879A

United States Patent [19]

Endo et al.

[11] Patent Number: 5,857,879

[45] Date of Patent: Jan. 12, 1999

[54] FEMALE TERMINAL FOR LARGE CURRENT

[75] Inventors: Takayoshi Endo; Kazuhisa Ishizaki; Shigemi Hashizawa, all of Shizuoka, Japan

[73] Assignee: Yazaki Corporation, Tokyo, Japan

[21] Appl. No.: 947,351

[22] Filed: Oct. 8, 1997

[30] Foreign Application Priority Data

Oct. 11, 1996 [JP] Japan ..... 8-270342

[51] Int. Cl.[6] ..... H01R 13/00

[52] U.S. Cl. ..... 439/851; 439/843

[58] Field of Search ..... 439/851, 843, 439/846, 823, 839

[56] References Cited

U.S. PATENT DOCUMENTS

| | | | |
|---|---|---|---|
| 2,221,651 | 11/1940 | Pelz | 439/823 |
| 3,924,922 | 12/1975 | DeCenzo | 439/839 |
| 4,874,338 | 10/1989 | Bakermans | 439/851 |
| 5,449,304 | 9/1995 | Huss, Jr. et al. | 439/843 |
| 5,620,347 | 4/1997 | Sawada | 439/851 |
| 5,628,656 | 5/1997 | Macioce et al. | 439/851 |
| 5,667,413 | 9/1997 | Trafton | 439/843 |

FOREIGN PATENT DOCUMENTS

| | | | |
|---|---|---|---|
| 4242972 | 6/1994 | Germany | 439/843 |
| 59-93086 | 6/1984 | Japan . | |
| 940437 | 10/1963 | United Kingdom | 439/839 |

*Primary Examiner*—Neil Abrams
*Assistant Examiner*—Javaid H. Nasri
*Attorney, Agent, or Firm*—Armstrong, Westerman, Hattori, McLeland & Naughton

[57] ABSTRACT

A female terminal for a large current is provided which includes a tubular contact portion having an inlet for inserting a terminal pin of a male terminal. The female terminal for a large current also includes a plurality of projections formed on an inner face of the tubular contact portion, which is adjacent to the inlet, which has adequate spaces therebetween, and which protrudes inwardly of the tubular contact portion. The plurality of projections are formed from outside of the terminal contact portion easily and at a low cost.

3 Claims, 3 Drawing Sheets

FEMALE TERMINAL FOR LARGE CURRENT

FIELD OF THE INVENTION

The present invention relates to a female terminal for large current for use with a charging connector for electric motor vehicles or similar and more particularly, to an improved structure of the female terminal's connecting portion with a male terminal.

DESCRIPTION OF THE RELATED ART

In order to stabilize contact resistance between a female terminal and a male terminal, a structure of point contact has been employed, wherein the female terminal has a plurality of projections in a portion thereof for providing electric contact with the male terminal. By employing such a structure of point contact, an oxide film can be broken and current interruption under vibration can be prevented. Moreover, since the female terminal for large current requires as large a cross-sectional area as possible, it has been conventionally formed by machining a round bar of pure copper or copper alloy. For example, Japanese Utility Model Laid-open Publication No. 59-93086 discloses a socket structure as shown in drawing FIG. 7. The structure comprises a socket pin 31 having a tubular contact portion 32 whose inner periphery is provided with a longitudinal slit 33 and a plurality of serrated grooves 34, thereby enabling a terminal pin 35 to be stably received in the socket pin 31.

The tubular contact portion 32 can be relatively easily manufactured by machining the aforementioned round bar. However, it is difficult to form the serrated grooves 34 with such a boring tool 36 as shown in FIG. 8. The tool 36 itself is likely to wear due to its structural weakness. For stabilizing contact resistance, it is preferable to form a plurality of projections instead of the serrated grooves 34, but such projections are difficult to produce by machining.

SUMMARY OF THE INVENTION

In view of the above-described drawbacks, it is an object of the present invention to provide a female terminal for large current which assures a stable contact resistance and can be easily manufactured at low cost.

In order to attain the above-described object, a first aspect of the present invention resides in a female terminal comprising a tubular contact portion for receiving a terminal pin of a male terminal characterized in that an annular thin portion is formed around an outer periphery of the tubular contact portion adjacent to an inlet for inserting the terminal pin, the thin portion being formed with appropriate spaces with a plurality of projections protruding inwardly of the tubular contact portion.

The thin portion around the outer periphery of the tubular contact portion can be easily formed by machining and the inwardly protruding projections can also be formed easily by embossing from the outside. Therefore, production of the female terminal for large current can be achieved at low cost, and the inward projections formed in the tubular contact portion assures a good contact stability with the terminal pin of the male terminal.

According to another aspect of the present invention, a plurality of pin holding holes are formed at appropriate positions in a peripheral wall of the tubular contact portion adjacent to the terminal pin insertion inlet. Into each of the pin holding holes, a pin-like projection is fitted in such a manner that its end projects inwardly of the tubular contact portion.

According to a further aspect of the present invention, an annular thin area is formed in the inner periphery of the tubular contact portion adjacent to the terminal pin insertion inlet. A contact ring having a plurality of projections formed on its inner periphery is fitted to the annular thin area.

According to the second and third aspects, the pin-like projections and the contact ring are not integral with the tubular contact portion, but rather are separate parts. Further, the pin-like projections and the contact ring can be obtained by working from the outside of the tubular contact portion and thus, desired effects and advantages can be obtained as well as in the first aspect.

BRIEF DESCRIPTION OF THE DRAWING FIGURES

These and other objects, features, and advantages of the present invention will become apparent from the following detailed description of the preferred embodiments and best mode, appended claims, and accompanying drawing figures, in which:

Figure 7A:
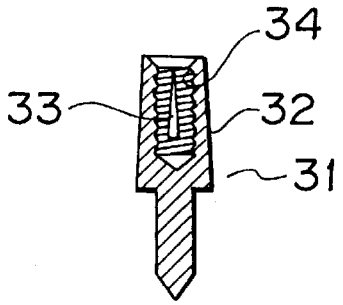
FIG. 7A PRIOR ART
FIG. 7A is a cross-sectional view of a conventional socket pin 31.
Figure 7B:
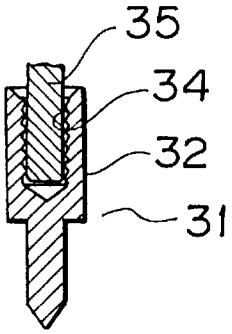
FIG. 7B PRIOR ART
Figure 8:
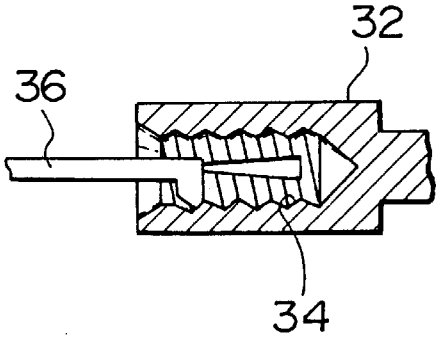
FIG. 8 PRIOR ART

FIG. 7B is a cross-sectional view showing a terminal pin 35 inserted in the socket pin 31; and FIG. 8 is view for explaining a method of producing the socket pin 31 in FIGS. 7A and 7B.

DETAILED DESCRIPTION OF THE PREFERRED EMBODIMENTS

Figure 1A:
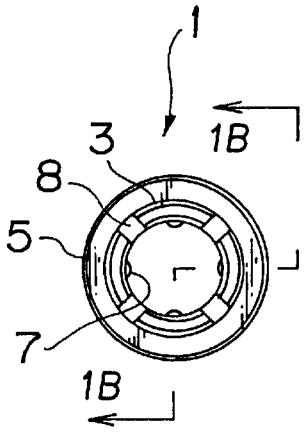
FIG. 1A is an end view of a female terminal for large current according to a first embodiment of the present invention.
Figure 1B:
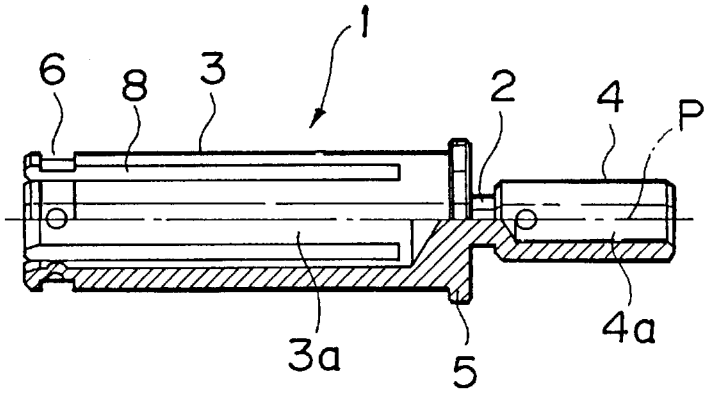
FIG. 1B is a cross-sectional view of FIG. 1A taken along a line X—X.
Figure 1C:
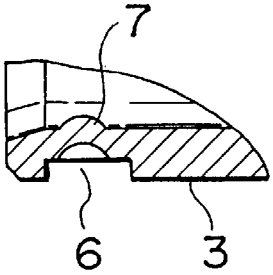
FIG. 1C is an enlarged cross-sectional view of the essential part of FIG. 1B.

In FIGS. 1A, 1B, and 1C, a female terminal 1 has a large-diametered tubular contact portion 3 in front of a neck portion 2 and a small-diametered electric wire connection 4 in the rear of the neck portion 2. The female terminal 1 is formed by machining a round stock of conductive metal such as copper, copper alloy, etc.

The tubular contact portion 3 has a receiving bore 3*a* into which a terminal pin 35 is inserted (See FIG. 7B). The electric wire connection 4 has a core wire insertion bore 4*a* for inserting a core wire of a covered electric wire (not shown) and connecting therewith by caulking, etc. A flange 5 is formed around a base end of the tubular contact portion 3 for engaging with a locking arm in a terminal receiving chamber of a connector housing (not shown) for prevention of retraction or withdrawal therefrom.

The structure is identical to the conventional one so far, but in the present invention an annular thin portion 6 is formed around the outer periphery of the tubular contact portion 3 adjacent to the inlet end. A plurality of projections 7 are formed in the thin portion 6 in such a manner that the projections 7 protrude inwardly of the tubular contact portion 3 with adequate spaces therebetween.

Further, longitudinal slits 8 extending from the inlet end to the base end are formed between each pair of projections 7, 7. Divided pieces of the tubular contact portion 3, defined by means of the longitudinal slits 8, serve as resilient contact pieces for the terminal pin. In the illustrated embodiment, four projections 7 are formed in four directions around the terminal axis P (horizontal and vertical). However, the number of the projections 7 may be optionally selected within a range of 3 to 8.

Figure 2:
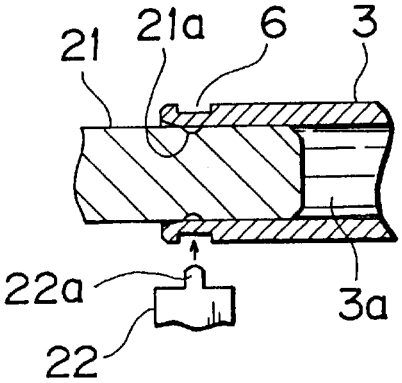
FIG. 2 is a view for explaining the method of producing the female terminal 1 in FIGS. 1A, 1B, and 1C.

Referring to FIG. 2, a method of forming the projection 7 is now explained. Into a receiving bore 3*a* of the tubular contact portion 3, a mandrel 21 is inserted. The mandrel 21 has a concave recess or groove 21*a* in an outer periphery thereof. Next, a convex projection 22*a* of a punch-like metal mold 22, is driven toward the concave recess or groove 21*a* from outside of the thin portion 6. A height of the projection 7 above the inner face of the tubular contact portion 3 can be easily adjusted by changing the depth of the concave recess or groove 21*a* of the mandrel 21.

It is easy to form the thin portion 6 by machining from the outside in the tubular contact portion 3 (which is produced by machining the round stock). The projections 7 can also be formed easily by the method as shown in FIG. 2.

The thud obtained female terminal 1 for large current has four projections 7 inside of the tubular contact portion 3 and assures a stable contact resistance with the terminal pin inserted in the receiving bore 3*a*, because the projections 7 provide point contact with the outer periphery of the terminal pin 35, and the divided pieces, defined by the longitudinal slits 8, provide appropriate resilient contact therewith allowing smooth insertion and retraction of the terminal pin 35.

Figure 3A:
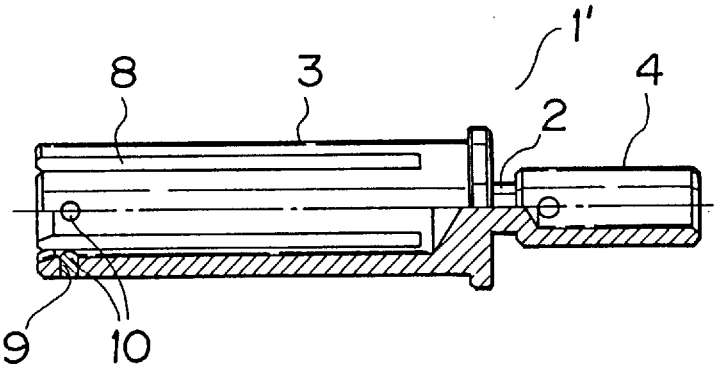
FIG. 3A is a cross-sectional view of a female terminal for large current according to a second embodiment of the present invention.
Figure 3B:
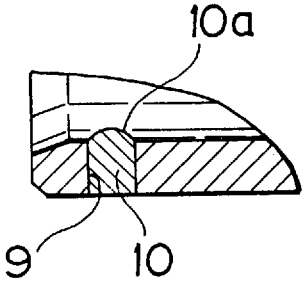
FIG. 3B is an enlarged cross-sectional view of the essential part of FIG. 3A.

Referring to FIGS. 3A and 3B, a female terminal 1' for large current is formed with a plurality of pin holding holes 9 in the peripheral wall of the tubular contact portion 3 adjacent to the inlet for inserting the terminal pin 35 with adequate spaces therebetween. A pin-like projection 10, having an end 10*a* formed in a hemispherical shape, is fitted into each of the pin holding holes 9 so that the pin-like projection's end 10*a* projects inwardly of the tubular contact portion 3.

Figure 4:
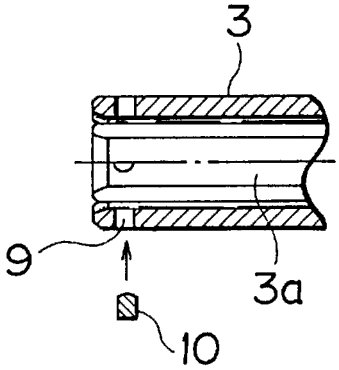
FIG. 4 is a view for explaining a method of producing the female terminal 1' in FIGS. 3A and 3B.

As shown in FIG. 4, the female terminal 1' can be manufactured easily by forming the pin holding holes 9 from the outside, then pressure fitting the pin-like projections 10 into the holes 9, and soldering if desired, after the pressure fitting to fix the pin-like projections 10. The material of the pin-like projection 10 can be selected independently from that of the tubular contact portions 3 because the pin-like projections 10 are separate parts. More stable contact resistance can be obtained by selecting a material of higher wear resistance for the pin-like projection 10, wherein the higher wear resistant material is different from the material of the tubular contact portion 3.

Figure 5B:
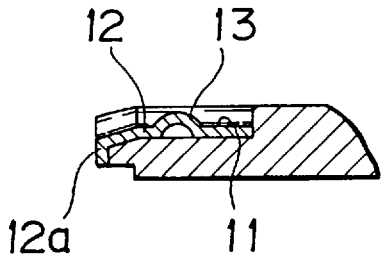
FIG. 5B is an enlarged cross-sectional view of the essential part of FIG. 5A.
Figure 5A:
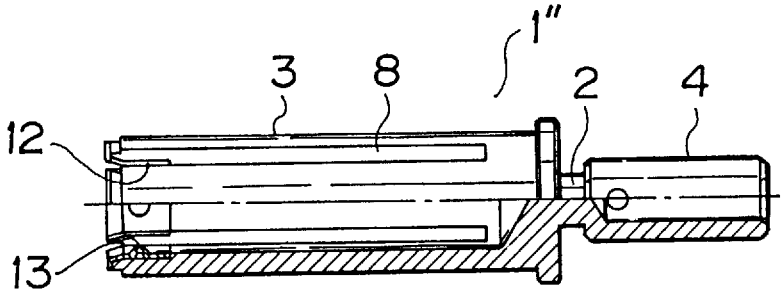
FIG. 5A is a cross-sectional view of a female terminal for large current according to a third embodiment of the present invention.

Referring to FIGS. 5A and 5B, a female terminal 1" for large current is formed with an annular thin area 11 in the inner periphery of the tubular contact portion 3 adjacent to the inlet for inserting the terminal pin 35. A contact ring 12 is fitted in the annular thin area 11, wherein the contact ring 12 has a plurality of projections 13 provided on an inner wall thereof with adequate spaces between each projection 13 of the plurality of projections 13.

The contact ring 12 is rather tapered with a forward end slightly larger in diameter than a rearward end thereof to facilitate insertion into the thin area 11 of the tubular contact portion 3. The forward end of the contact ring 12 is bent outwardly to form a bell mouth 12*a*. The projections 13 are adapted to project inwardly similarly to the embodiment shown in FIG. 1.

Figure 6:
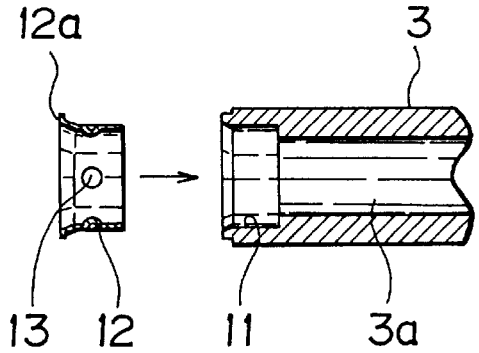
FIG. 6 is a view for explaining a method of producing the female terminal 1" in FIGS. 5A and 5B.

The female terminal 1" for large current can also be manufactured easily, because production of both the annular thin area 11 and the separate contact ring 12 can be done with ease. As shown in FIG. 6, the contact ring 12 is inserted in the opening of the tubular contact portion 3 to fit in the annular thin area 11 and fixed by soldering, and then longitudinal slits 8 are formed.

Selection of the material for the contact ring 12 is optional similarly to the female terminal 1'. Material of higher wear resistance can be employed for the contact ring 12 which is a separate part from the tubular contact portion 3.

According to the present invention, the projections, in the tubular contact portion of the female terminal intended to contact the male terminal, are formed from the outside. This allows the female terminal for large current to be manufactured easily and at low cost. Due to the point contact between the male terminal and the projections on the inner face of the tubular contact portion, a stable contact resistance can be obtained.

What is claimed is:

1. A female terminal for large current comprising:

a tubular contact portion for insertion of a terminal pin of a male terminal therein, wherein said tubular contact portion has a same circular cross-section at any point in a direction of a longitudinal axis of said tubular contact portion;

a plurality of projections projecting from an inner face of an annular thin portion and evenly spaced in a peripheral direction so as to attain point contact with the terminal pin;

a plurality of longitudinal slits dividing said tubular contact portion into a plurality of resilient contact pieces, wherein each of said plurality of resilient contact pieces corresponds to each of said plurality of projections; and whereby said plurality of projections are resiliently put into said point contact with the terminal pin thereby enabling smooth insertion/retraction of the terminal pin against said tubular contact portion and also enabling stable contact resistance between said tubular contact portion and the terminal pin.

2. A female terminal for large current comprising:

a tubular contact portion for insertion of a terminal pin of a male terminal therein, wherein said tubular contact portion has a same circular cross-section at any point in a direction of a longitudinal axis of said tubular contact portion;

a plurality of pin holding holes penetrating a peripheral wall adjacent to an inlet of said tubular contact portion and evenly spaced in a peripheral direction;

a plurality of pins fitted into each of said plurality of pin holding holes and projecting from an inner face of said tubular contact portion so as to attain point contact with the terminal pin;

a plurality of longitudinal slits dividing said tubular contact portion into a plurality of resilient contact pieces, wherein each of said plurality of resilient contact pieces corresponds to each of said plurality of pins; and whereby said plurality of pins are resiliently put into said point contact with the terminal pin thereby enabling smooth insertion/retraction of the terminal pin against said tubular contact portion and also enabling stable contact resistance between said tubular contact portion and the terminal pin.

3. A female terminal for large current comprising:

a tubular contact portion for insertion of a terminal pin of a male terminal therein, wherein said tubular contact portion has a same circular cross-section at any point in a direction of a longitudinal axis of said tubular contact portion;

a contact ring fitted inside of an annular thin portion formed at an inlet of said tubular contact portion and made of any one of a same material and a different material as a material of said tubular contact portion;

a plurality of projections projecting from an inner face of said contact ring and evenly spaced in a peripheral direction so as to attain point contact with the terminal pin; and whereby said plurality of projections are resiliently put into said point contact with the terminal pin thereby enabling stable contact resistance between said tubular contact portion and the terminal pin.

* * * * *